US005417517A

United States Patent [19]

Zollers

[11] Patent Number: 5,417,517

[45] Date of Patent: May 23, 1995

[54] VIBRATING TAMPING FLOAT

[76] Inventor: Ralph W. Zollers, 386 W. Main St., Trappe, Collegeville, Pa. 19426

[21] Appl. No.: 48,262

[22] Filed: Apr. 14, 1993

[51] Int. Cl.[6] ..... E01C 19/40

[52] U.S. Cl. ..... 404/113; 404/115; 404/133.05; 404/133.1

[58] Field of Search ..... 404/48, 97, 113, 114, 404/102, 133.05, 89; 425/432, 421

[56] References Cited

U.S. PATENT DOCUMENTS

| | | | |
|---|---|---|---|
| 1,945,145 | 1/1934 | Gordon | 404/113 |
| 2,446,028 | 7/1948 | Spanseller | 404/113 |
| 3,306,174 | 2/1964 | Wardell | 404/113 |
| 3,314,341 | 10/1964 | Schulin et al. | 404/113 |
| 3,338,144 | 8/1967 | Hart | 404/133.1 |
| 3,515,042 | 6/1976 | Austin | 404/113 |
| 4,950,102 | 8/1990 | Zeitz | 404/133.2 |
| 5,261,762 | 11/1993 | Yamaguchi | 404/133.05 |

*Primary Examiner*—Ramon S. Britts
*Assistant Examiner*—Pamela Anne O'Connor
*Attorney, Agent, or Firm*—John F. A. Earley; John F. A. Earley, III

[57] ABSTRACT

A vibrating tamping float for smoothing the top surface of freshly poured concrete, pushing coarse aggregates down into the concrete while allowing cream to surface, and reducing a formation of large air pockets in the concrete, includes a float body having a bottom surface and a pushing device for pushing coarse aggregates down into the concrete while allowing cream to surface. The pushing device includes a plurality of ribs mounted on the bottom surface of the float body. The ribs have a ramp on front and rear portions thereof for providing a smooth entrance into the concrete and pushing coarse aggregates downward as they are slid back and forth in the concrete. A vibrator is provided on the float body for vibrating the float body to reduce a formation of large air pockets in the concrete, to aid in pushing the coarse aggregates on the surface down into the concrete, and to aid in leveling-off and smoothing the top surface of the concrete.

8 Claims, 1 Drawing Sheet

VIBRATING TAMPING FLOAT

BACKGROUND OF THE INVENTION

FIELD OF THE INVENTION

This invention relates to a tamping float, and more particularly to a vibrating tamping float for smoothing the top surface of freshly poured concrete.

SUMMARY OF THE INVENTION

It is an object of this invention to provide a vibrating tamping float for smoothing the top surface of freshly poured concrete, pushing coarse aggregates down into the concrete while allowing cream to surface, and reducing the formation of large air pockets in the concrete.

These and other objects are accomplished by providing a vibrating tamping float which comprises a float body, pushing means for pushing coarse aggregates down into the concrete while allowing cream to surface, and vibrating means mounted on the float body. The float body has a bottom surface, and the pushing means includes a plurality of ribs mounted on the bottom surface of the float body. The ribs have ramp means on front and rear portions thereof for providing a smooth entrance into the concrete as they are slid back and forth in the concrete. The vibrating means aids in pushing the coarse aggregates on the surface down into the concrete, and in leveling-off the top surface of the concrete. Further, the vibrating means reduces entrapped air.

DETAILED DESCRIPTION

Figure 1:
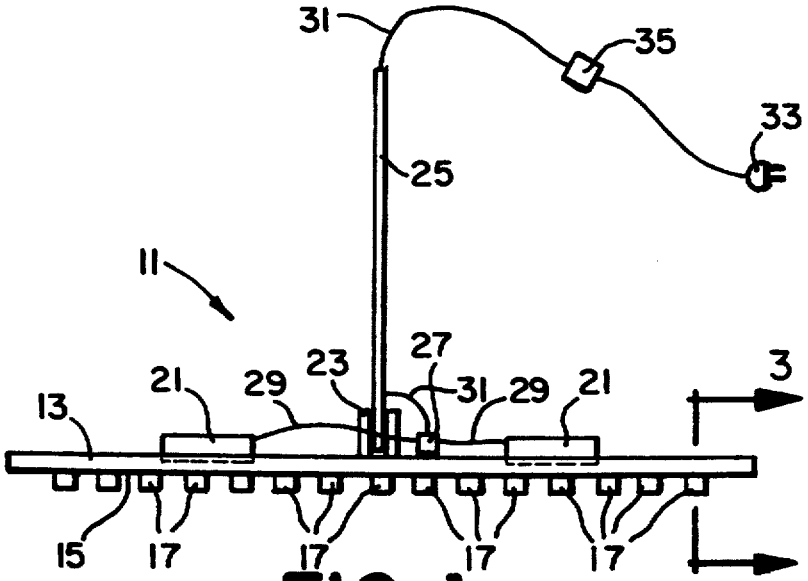
FIG. 1 is a view in front elevation of the tamping float of the invention.

Turning now to the drawings, FIG. 1 shows a vibrating tamping float 11 which comprises a float body 13 having top surface 14 and bottom surface 15, and pushing means for pushing coarse aggregates down into the concrete while allowing cream to surface. The pushing means includes a plurality of ribs 17 mounted on the bottom surface 15 of the float body 13. The vibrating tamping float 11 also includes vibrating means 21 bolted to the top surface 14 of the float body 13 for vibrating the float body 13 to reduce a formation of large air pockets in the cement, to aid in pushing the coarse aggregates on the surface down into the concrete, and to aid in leveling-off the top surface of the concrete. The vibrating means 21 may be a vibrator, such as a 1/20 horsepower electric vibrator or equivalent made by a commercial manufacturer i.e., B.E.S.T. or equivalent. The number of vibrators 21 may vary. For example, a 2-foot long float 11 may only need a single vibrator 21, while an 8-foot float may need 4 vibrators 21.

Figure 3:
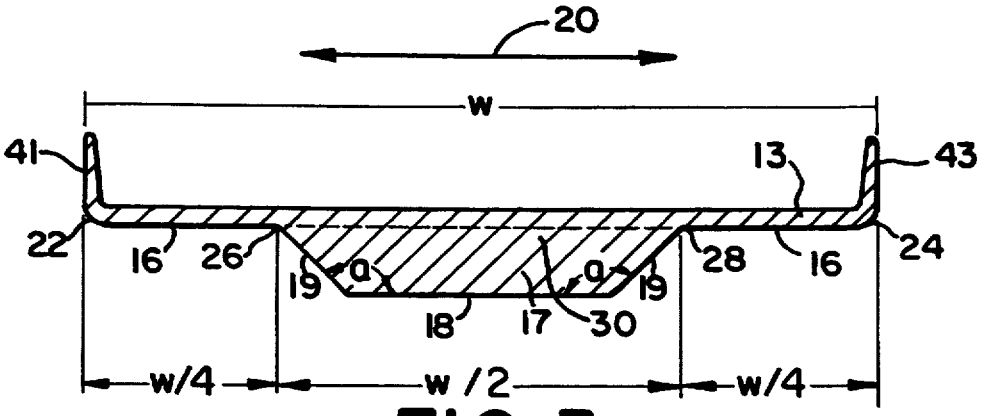
FIG. 3 is a view in cross-section taken along the lines and arrow 3—3 of FIG. 1.

As shown in FIG. 3, the ribs 17 have ramp means 19 disposed on front and rear portions thereof and extending from portions 26 or 28 of the bottom surface 15 of the float body 13 to the flat bottom portion 18 of the ribs 17, for providing a smooth entrance of the ribs 17 into the concrete as the ribs 17 are slid back and forth therein.

The working surface of the tamping float 11 may be divided into three portions: the two flat outer portions

16 of the bottom surface 15 of the float body 13, which extend from first end 22 to the portion 26 and from second end 24 to the portion 28, and one central section 30 of the float 11 between portions 26 and 28 which contains ramp means 19 and flat bottom portion 18 of the ribs 17. The three portions are perpendicular to the major axis of the length of the float 11, which corresponds to the direction 20 shown by the lines and arrows of FIG. 3. The two flat outer portions 16 are preferably equal in width and together comprise ½ of the width w of the tamping float 11, each of the flat outer portions 16 preferably having a width of w/4 as shown in FIG. 3. The central section 30 of the tamping float 11 contains the ribs 17 which are preferably equal in largest dimension to ½ of the width w of the bottom surface 15 of the float body 13, shown as w/2 in FIG. 3.

Figure 2:
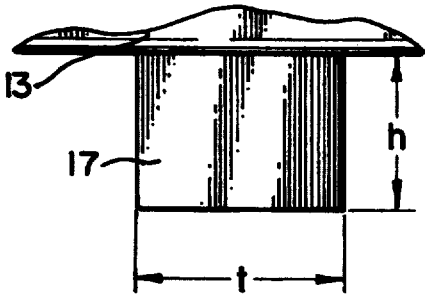
FIG. 2 is a front or rear view of a rib.

Referring to FIGS. 1 and 2, the ribs 17 are preferably symmetrical in design and equally spaced. Ribs 17 have a thickness t and a height h and a spacing between adjacent ribs 17 that is appropriate to handle the size of the aggregates in the concrete. For example, for ¾ inch stone aggregates, ribs 17 may have a thickness t of ½ inch, a height h of ½ inch, and a spacing of ½ inch between each adjacent rib 17. The spacing between adjacent ribs 17 is preferably approximately equal to the rib thickness t of the ribs 17.

The ramp means 19 of the ribs 17 are tapered to permit smooth functioning of the tamping float 11. A purpose of the ribs 17 is to force coarse aggregates down while permitting cream in the concrete to surface. This facilitates smoothing the top surface of freshly poured concrete. Preferably, the angle "a" between the flat bottom portion 18 of rib 17 and the surface of ramp means 19 is 150 to 160 degrees.

As shown in FIG. 3, the float body 13 has the first end 22 and the second end 24 between which the ribs 17 extend, the ribs 17 being disposed only at the central portion 30 of the bottom surface 15 of the float body 13 so as to leave flat outer portions

16 of the bottom surface 15 of the float body 13 exposed to the concrete for smoothing its surface. The flat outer portions 16 have a smooth surface to permit formation of a smooth finish on the top surface of freshly poured concrete.

The vibrating tamping float 11 includes means for sliding the float body 13 back and forth over the surface of the concrete. The sliding means comprises a variable angle bracket assembly 23 which is mounted on the top surface 14 of the float body 13 for moving the float body 13 in the direction 20 at any desired angle. The vibrating tamping float 13 may include a handle 25 for permitting a user to push or pull the float body 13 across the surface of the concrete. The handle 25 is operatively connected to the variable angle bracket assembly 23. As shown in FIG. 1, the variable angle bracket 23 assembly and handle 25 are preferably mounted at a center of the float body 13 and permit operation in either direction at any desired angles.

As shown in FIG. 1, a junction box 27 is mounted on top surface 14 of float body 13 and joins the power cord 29 of each vibrator means 21 to the primary electric power source cord 31, which may be connected to an electric power source via a plug 33. Power source cord 31 has an on/off switch 35 so that the vibrator(s) 21 may be easily turned off when changing direction of movement of the float body 13 or at any desired time.

Preferably, handle 25 is hollow and cord 31 runs through it entering at an opening at the bottom end portion of the handle 25 and exiting handle 25 at an opening in the top end portion of the handle 25.

Float body 13 has an upwardly extending flange 41 at first end 22 and an upwardly extending flange 43 at second end 24. Flanges 41 and 43 provide stability to float body 13 so that float body 13 is not deflected or prone to bend between first end 22 and second end 24. The outer junction between each flange 41 and 43 and the bottom surface 15 of float body 13 preferably has a radius of ⅛ inch.

In operation, a tamping float 11 is chosen that has ribs 17 that are sized and spaced to accommodate the size of the aggregate in the concrete. The variable angle bracket 23 is positioned at an angle desired by a user. The handle 25 is connected to the variable angle bracket 23 to facilitate movement of the float body 13 of the tamping float 11 in the direction 20.

After concrete with aggregates of particular sizes has been freshly poured relatively evenly so that the top surface of the concrete is fairly flat, the vibrating means 21 of the tamping float 11 is turned on, and tamping float 11 is pushed and pulled across the top surface of the freshly poured concrete using handle 25 until the surface is smooth.

A method of finishing the top surface of freshly poured concrete according to the invention with the vibrating tamping float 11 includes the steps of moving the float body 13 across the surface of the concrete, penetrating the concrete with the ribs 17, pushing coarse aggregates on the surface of the concrete and within the concrete down into the concrete with the ribs 17 and the vibrator 21, reducing a formation of large air pockets or honeycombs in the cement with ribs 17 and the vibrating means 21, causing cream in the concrete to rise to the surface with the ribs 17 and the vibrating means 21, and leveling-off the surface of the concrete with the flat bottom portion 18 of the ribs 17, and flat outer portions 16 of the bottom surface 15 of the float body 13.

With higher slump concrete (e.g., 4 inch plus), it may not be necessary to turn on the vibrator 21 because movement of the tamping float 11 alone back and forth across the concrete is sufficient to cause the cream of the concrete to rise.

ADVANTAGES

The tamping float 11 of the present invention permits smoother finishing of "low slump" concrete mix. It also pushes coarse aggregates down while permitting the cream or paste to migrate to the top surface such that a layer of at least one eighth inch of cream is deposited at the top surface of the concrete. In addition, the vibration permits coarse aggregates to settle while removing trapped air which otherwise could cause honeycomb defects within the body of the concrete structure. Removal of honeycomb defects is desirable because such defects could otherwise weaken the concrete structure.

The above disclosure is related to the preferred embodiment of the present invention. However, it will be understood that the present invention may be embodied otherwise than as herein specifically illustrated or described, and that certain changes in the form and arrangement of parts and of practicing the invention may be made without departing from the spirit of the invention as defined by the scope of the appended claims.

I claim:

1. A vibrating tamping float for smoothing the top surface of freshly poured concrete, pushing coarse aggregates down into the concrete while allowing cream to surface, and reducing a formation of large air pockets in the concrete, comprising a horizontally extending float body having a bottom surface, pushing means for pushing coarse aggregates down into the concrete while allowing cream to surface, said pushing means including a plurality of vertically extending ribs mounted on the bottom surface of the float body for pushing the coarse aggregates downward, the ribs being disposed only at a central portion of the bottom surface of the float body so as to leave flat portions along the entire periphery of the bottom surface of the float body exposed to the concrete for smoothing its surface, the ribs having ramp means on front and rear portions thereof for providing a smooth entrance of the ribs into the concrete as the ribs are slid back and forth in the concrete, and vibrating means mounted on the float body for vibrating the float body to reduce a formation of large air pockets in the cement, to aid in pushing the coarse aggregates on the surface down into the concrete, and to aid in leveling-off the top surface of the concrete.

2. The vibrating tamping float of claim 1, further comprising means for sliding the float body back and forth over the surface of the concrete, said sliding means being mounted on the float body.

3. The vibrating tamping float of claim 2, said sliding means comprising variable angle bracket means mounted on the float body for receiving a handle for moving the float body in either direction of the ribs at any desirable angle within the constraints of the angle bracket means.

4. The vibrating tamping float of claim 3, further comprising handle means for permitting a user to push or pull the float body across the surface of the concrete, said handle means being operatively connected to said bracket means.

5. A vibrating tamping float for smoothing the top surface of freshly poured concrete, pushing coarse aggregates down into the concrete while allowing cream to surface, and reducing a formation of large air pockets in the concrete, comprising a horizontally extending float body having a bottom surface, pushing means for pushing coarse aggregates down into the concrete while allowing cream to surface, said pushing means including a plurality of vertically extending ribs mounted on the bottom surface of the float body for pushing the coarse aggregates downward, the ribs having ramp means on front and rear portions thereof for providing a smooth entrance of the ribs into the concrete as the ribs are slid back and forth in the concrete, vibrating means mounted on the float body for vibrating the float body to reduce a formation of large air pockets in the concrete, to aid in pushing the coarse aggregates on the surface down into the concrete, and to aid in leveling-off the top surface of the concrete, sliding means for sliding the float body back and forth over the surface of the concrete, said sliding means being mounted on the float body, said sliding means comprising variable angle bracket means mounted on the float body for receiving a handle for moving the float body in either direction of the ribs at desired angles, and to support an electric vibrator power cord and handle means for permitting a user to push or pull the float body across the surface of the concrete, said handle means being operatively connected to said bracket means, the ribs being disposed only at a central portion of the bottom surface of the float body so as to leave flat portions along the entire periphery of the bottom surface of the float body exposed to the concrete for smoothing its surface.

6. A method of finishing the top surface of freshly poured concrete with a vibrating tamping float comprising a horizontally extending float body having a bottom surface, pushing means for pushing coarse aggregates down into the concrete while allowing cream to surface, said pushing means including a plurality of vertically extending ribs mounted on the bottom surface of the float body for pushing the coarse bodies downwardly, the ribs having ramp means on front and rear portions thereof for providing a smooth entrance of the ribs into the concrete and for pushing coarse aggregates downward as the ribs are slid back and forth in the concrete, and vibrating means mounted on the float body for vibrating the float body to reduce a formation of large air pockets in the concrete, to aid in pushing the coarse aggregates on the surface down into the concrete, and to aid in leveling-off the top surface of the concrete, said method comprising the steps of moving the float body across the surface of the concrete, providing a smooth entrance of the ribs into the concrete with the ramp means, smoothly entering the concrete with the ribs, penetrating the concrete with the ribs of said pushing means, sliding the ribs back and forth in the concrete, pushing coarse aggregates on the surface of the concrete and within the concrete down into the concrete with the ribs of said pushing means and said vibrating means, vibrating the float body to reduce formation of large air pockets in the concrete with the ribs of said pushing means and said vibrating means, causing cream in the concrete to rise to the surface with the ribs of said pushing means and said vibrating means, and leveling-off the surface of the concrete with the bottom surface of the float body and the vibrating means.

7. A method of finishing the top surface of freshly poured concrete with a vibrating tamping float comprising a float body having a bottom surface, pushing means for pushing coarse aggregates down into the concrete while allowing cream to surface, said pushing means including a plurality of ribs mounted on the bottom surface of the float body, the ribs having ramp means on front and rear portions thereof for providing a smooth entrance of the ribs into the concrete and for pushing coarse aggregates downward as the ribs are slid back and forth in the concrete, and vibrating means mounted on the float body for vibrating the float body to reduce a formation of large air pockets in the concrete, to aid in pushing the coarse aggregates on the surface down into the concrete, and to aid in leveling-off the top surface of the concrete, said method comprising the steps of moving the float body across the surface of the concrete, penetrating the concrete with the ribs of said pushing means, pushing coarse aggregates on the surface of the concrete and within the concrete down into the concrete with the ribs of said pushing means and said vibrating means, reducing a formation of large air pockets in the concrete with the ribs of said pushing means and said vibrating means, causing cream in the concrete to rise to the surface with the ribs of said pushing means and said vibrating means, and leveling-off the surface of the concrete with the bottom surface of the float body and the vibrating means, the float body having first and second ends between which the ribs extend, the ribs being disposed only at a central portion of the bottom surface of the float body so as to leave flat outer portions of the bottom surface of the float body at the first and second ends exposed to the concrete, the exposed outer portions of the bottom surface of the float body being used to level-off the surface of the concrete, vibrating the exposed portions of the bottom surface of the float body to level-off the surface of the concrete.

8. A method of finishing the top surface of freshly poured concrete with a vibrating tamping float comprising a horizontally extending float body having a bottom surface, pushing means for pushing coarse aggregates down into the concrete while allowing cream to surface, said pushing means including a plurality of vertically extending ribs mounted on the bottom surface of the float body for pushing the coarse bodies downwardly, the ribs having ramp means on front and rear portions thereof for providing a smooth entrance of the ribs into the concrete and for pushing coarse aggregates downward as the ribs are slid back and forth in the concrete, and vibrating means mounted on the float body for vibrating the float body to reduce a formation of large air pockets in the concrete, to aid in pushing the coarse aggregates on the surface down into the concrete, and to aid in leveling-off the top surface of the concrete, said method comprising the steps of pushing coarse aggregates on the surface of the concrete and beneath the surface of the concrete down into the concrete with mechanical and vibrational energy, reducing a formation of large air pockets in the concrete by causing them to rise to the surface of the concrete, causing cream in the concrete to rise to the surface of the concrete, and leveling-off the surface of the concrete with mechanical and vibrational energy.

* * * * *